US006143075A

United States Patent [19]

Osbon

[11] Patent Number: 6,143,075

[45] Date of Patent: Nov. 7, 2000

[54] PHOTO-FIBER LINK GLUE CONTROL SYSTEM

[76] Inventor: Edward E Osbon, 806 Guyton Rd., West Monroe, La. 71292

[21] Appl. No.: 09/046,210

[22] Filed: Mar. 23, 1998

[51] Int. Cl.[7] ..... B05B 5/00

[52] U.S. Cl. ..... 118/302; 118/696; 118/697; 118/698; 118/668; 118/669

[58] Field of Search ..... 118/696, 697, 118/698, 668, 669, 673, 672, 302

[56] References Cited

U.S. PATENT DOCUMENTS

| | | | |
|---|---|---|---|
| 3,590,775 | 7/1971 | Barr | 118/667 |
| 4,031,854 | 6/1977 | Sprague, Jr. | 118/641 |
| 4,357,900 | 11/1982 | Buschor | 118/681 |
| 4,389,971 | 6/1983 | Schmidt | 118/669 |
| 4,527,510 | 7/1985 | Arndt | 118/669 |
| 5,217,745 | 6/1993 | Patel | 427/8 |

*Primary Examiner*—Francis J. Lorin

*Attorney, Agent, or Firm*—MIchael I. Kroll

[57] ABSTRACT

A photo-fiber link glue control system (10) for accurately placing a pattern of glue on a sequential series of targets traveling with a conveyor (54) through the system (10). The system (10) includes an air reservoir (18) and a glue tank (24) for storing glue to be applied to the series of targets. A glue head (32) is connected to receive glue from the glue tank (24) for application to the series of targets. The lead and trailing edge of the target is detected by photo-eye sensors (44, 46) which generate a target position signal indicative of the sensed position. The pressure within the air reservoir (18) and glue tank (24) are monitored and a control device (36) stores a pattern in which the glue is to be applied to the target. Based upon the sensed pressure values, the sensed target position and the stored pattern, the control device (36) enables an air compressor (12) to receive air for delivery to the air reservoir (18) thus increasing the pressure therein and applying a pressure on the glue tank (24) causing glue to flow to the glue applicator (32) for placement on the target in accordance with the stored pattern.

19 Claims, 5 Drawing Sheets

PHOTO-FIBER LINK GLUE CONTROL SYSTEM

BACKGROUND OF THE INVENTION

1. Field of the Invention

The instant invention relates generally to systems for applying glue to a target and, more specifically, to a device for accurately placing a glue pattern on a plurality of successive targets and cleaning the glue tip of the applicator.

2. Description of the Prior Art

Numerous systems for placement of a glue pattern on a target are provided in the prior art. For example, U.S. Pat. Nos. 4,357,900; 4,389,971; 4,527,510; and 5,217,745 are all illustrative of such prior art. While these units may be suitable for the particular purpose to which they address, they would not be as suitable for the purposes of the present invention as heretofore described.

U.S. Pat. No. 4,357,900

Inventor: Karl Buschor

Issued: Nov. 9, 1982

An apparatus is disclosed for the automatic coating of articles. The apparatus has a spray device controlled by a programmed control device. A transport device transports the articles along a predetermined path to a coating position and then away therefrom after coating. A sensor monitors the position of the article and generates signals representative thereof, preferably generating one signal each time the article moves a predetermined distance (e.g. 2 cm.) along the path. A second sensor generates additional signals to the control device when an article passes a predetermined point, also indicating which of several types of articles has been detected. The control device controls the spraying process responsive to these signals. If desired, portions of the article that are moved sequentially into the coating position can be sprayed in different manners, e.g. with the spray devices positioned or oriented differently, or using different coating materials, etc. The control device is preferably reprogrammable.

U.S. Pat. No. 4,389,971

Inventor: Robert W. Schmidt

Issued: Jun. 28, 1983

A control for regulating the application of glue to a defined area of a moving paper board box blank includes a sensor for detecting the presence of the leading and trailing edges of a moving defined glue application area; a glue applicator spaced a fixed distance from the sensor; a pulse generator providing pulses indicative of movement of the application area; and counting means which are connected to the sensor, glue applicator and pulse generator. The sensor initiates a counting action at detection of the leading edge of a glue application after a predetermined number of counted pulses representative of the fixed distance between the sensor and glue applicator. The sensor initiates a second counting action at detection of the trailing edge of a glue application area and the counting means stops glue application after the same predetermined number of pulses representative of the sensor glue applicator fixed distance.

U.S. Pat. No. 4,527,510

Inventor: Raymond J. Arndt

Issued: Jul. 9, 1985

An improvement in apparatus for applying a coating to a surface of a moving work piece including a coating dispenser having at least one coating outlet for dispensing a stream of coating. A dispenser control unit is operatively coupled with the dispenser for normally initiating and terminating the dispensing of the stream of coating as predetermined parts of the work piece surface come into alignment with the coating outlet in response to the speed and position of the work piece surface. The invention provides a minimum coating control co-acting with the dispenser control unit for depositing a coating of a selectable minimum length to at least one portion of the work piece surface, said selectable minimum length being substantially less than that achievable by said dispenser control unit alone.

U.S. Pat. No. 5,217,745

Inventor: Baldev Patel

Issued. Jun. 8, 1993

Method and apparatus for applying a programmable pattern to a succession of moving objects, comprising a microprocessor for storing a user defined value representing the length of the pattern, a clock for generating a series of pulses and a photo-eye for detecting the presence of the succession of moving objects. Upon detecting the presence of a first one of the moving objects, a set-up mode gate is enabled for transmitting the clock pulses to a first divider circuit. The first divider circuit divides the number of transmitted clock pulses by the user defined value and in response generates and stores a first count value. Upon detecting the presence of subsequent moving objects, a run mode gate transmits successive predetermined numbers of clock pulses to a second divider circuit. The second divider circuit divides the successive predetermined numbers of clock pulses by a first count value and in response generates successive further count values with the user defined value and in the event the values are equal initiates application of the programmable pattern to the succession of objects, and in the event more than a predetermined number of the successive further count values are not equal to the user defined value the microprocessor re-initiates the setup mode procedure.

BRIEF SUMMARY OF THE INVENTION

The present invention is concerned with systems for placing glue on a target and, more specifically, to a system for accurately positioning glue patterns on a plurality of successive targets and cleaning the tip of the glue applicator.

A primary object of the present invention is to provide a photo-fiber link glue control system able to accurately position a glue bead on a target An additional object of the present invention is to provide a photo-fiber link glue control system able to accurately place a glue bead on a number of successive targets passing beneath the glue applicator.

Another object of the present invention is to provide a photo-fiber link glue control system able to detect the initial presence of a target entering a glue placement area.

A further object of the present invention is to provide a photo-fiber link glue control system able to detect when the target has passed through the glue application area and causing operation of the glue applicator to cease.

A still further object of the present invention is to provide a photo-fiber link glue control system which is able to apply air from an air reservoir through the glue head when a target is not within the glue application area acting to clean the glue head of glue remaining thereon.

Another object of the present invention is to provide a photo-fiber link glue control system which is able to compensate for changes in the speed of the conveyor or mechanical tolerances acting on the conveyor or target.

A further object of the present invention is to provide a photo-fiber link glue control system including a plurality of glue applicators able to apply a complex glue pattern on a target.

A still further object of the present invention is to provide a photo-fiber link glue control system able to regulate a line pressure of the glue applicator and provide each target with a substantially identical glue pattern.

A yet further object of the present invention is to provide a photo-fiber link glue control system including a control keypad for activating only one glue applicator based upon sensor signals detecting presence of the target thereby preventing human error.

A photo-fiber link glue control system for accurately placing a pattern of glue on a sequential series of targets traveling with a conveyor through the system is disclosed by the present invention. The system includes an air reservoir and a glue tank for storing glue to be applied to the series of targets. A glue head is connected to receive glue from the glue tank for application to the series of targets. The lead and trailing edge of the target is detected by photo-eye sensors which generate a target position signal indicative of the sensed position. The pressure within the air reservoir and glue tank are monitored and a control device stores a pattern in which the glue is to be applied to the target. Based upon the sensed pressure values, the sensed target position and the stored pattern, the control device enables a compressor device to receive air for delivery to the air reservoir thus increasing the pressure within the air reservoir and increase a pressure within the glue tank forcing glue to flow to the glue head for application on the target in accordance with the stored pattern.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figures 1, 2, 3:
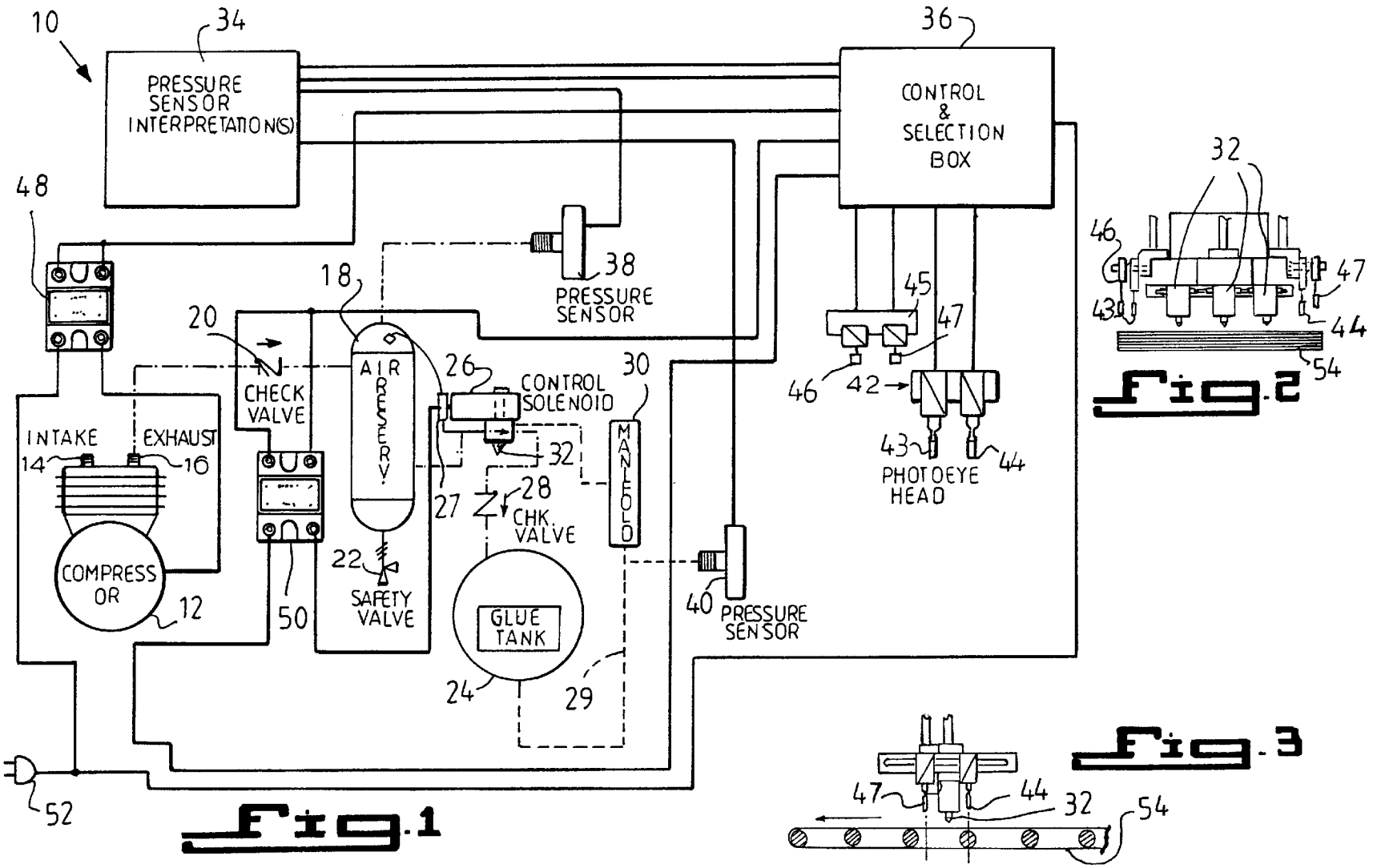
FIG. 1 is a schematic diagram illustrating the photo-fiber link glue control system of the present invention without the conveyor system.
FIG. 2 is an front elevational view of the glue applicator and conveyor system of the photo-fiber link glue control system shown in FIG. 1.
FIG. 3 is a side elevational view of the glue applicator and conveyor system of the photo-fiber link glue control system shown in FIG. 1.

Turning now descriptively to the drawings, in which similar reference characters denote similar elements throughout the several views, the Figures illustrate the photo-fiber link glue control system of the present invention. With regard to the reference numerals used, the following numbering is used throughout the various drawing figures.

10 photo-fiber link glue control system of the present invention
12 compressor
14 compressor intake
16 compressor exhaust
18 air reservoir
20 first check valve
22 safety valve
24 glue tank
26 control solenoid
27 air valve
28 second check valve
29 glue line
30 manifold
32 glue head
34 pressure sensor interpretations circuit
36 control and selections box
38 first pressure sensor
40 second pressure sensor
42 glue photo-eye head
43 lead photo-eye sensor of glue photo-eye head
44 trailing photo-eye sensor of glue photo-eye head
45 air photo-eye head
46 lead photo-eye sensor of air photo-eye head
47 trailing photo-eye sensor of air photo-eye head
48 first solid state relay
50 second solid state relay
52 power supply
54 conveyor belt
56 control logic circuit
58 position indicators
60 input position signal line
62 output position control signal line
64 stepper motor

66 threaded shaft
68 control circuit board
70 third solid state relay
72 fourth solid state relay
74 power supply circuit
76 first transformer
78 second transformer
80 keypad
82 third transformer
84 power supply circuit
86 LED pressure display
88 glue line pressure read section
90 air tank pressure read section
92 action section
94 arrow indicating supply of power to gates in action section
96 OR gate for first glue tank pressure control signal
98 OR gate for second glue tank pressure control signal
100 AND gate for first glue tank pressure control signal
102 AND gate for second glue tank pressure control signal
104 base section of glue head
106 glue applicator section depending from base section
108 glue hole
110 air holes

DETAILED DESCRIPTION OF THE PREFERRED EMBODIMENT

Turning now descriptively to the drawings, in which similar reference characters denote similar elements throughout the several views, FIGS. 1 through 11 illustrate the photo-fiber link glue control system indicated generally by the numeral 10.

The photo-fiber link glue control system 10 includes a compressor 12 having an air intake port 14 and an air exhaust port 16. Air enters the compressor 12 through the air intake port 14 and exits through the air exhaust port 16 traveling to an air reservoir 18 via a check valve 20. The air reservoir 18 includes a safety valve 22 for regulating the pressure therein and is connected to a control solenoid 26 via an air valve 27. A glue tank 24 is connected to the air reservoir 18 via the air valve 27, the control solenoid 26 and a second check valve 28. Air is supplied from the air reservoir 18 through the control solenoid 26 and check valve 28 to the glue tank 24 to force glue out of the glue tank 24. The glue tank 24 supplies the glue forced therefrom through a glue line 29 and a manifold 30 to a glue head 32 for application to a target (not shown). The glue head 32 is connected to the control solenoid 26 and is also connected via the air valve 33 to the air reservoir 18. The glue head 32 is designed to allow the flow of both air and glue therethrough as will be explained in more detail hereinafter.

The air pressure within the air reservoir 18 is monitored by a first pressure sensor 38 and the pressure within the glue tank 24 and glue line 29 is monitored by a second pressure sensor 40. The pressure values sensed by the first and second pressure sensors 38, 40 are transmitted to a pressure sensor interpretations circuit 34. Based upon the received pressure values, the pressure sensor interpretations circuit 34 detects pressure changes in the air reservoir 18 and glue tank 24 and transmits control signals indicative of such detected changes in pressure to a control and selection box 36. The control and selection box 36 acts to control the air pressure in the air reservoir 18 and the pressure in the glue tank 24. A rise in pressure in the glue tank 24 causes glue to be delivered through the glue line 29 to the glue head 32 for application to a target based upon a preprogrammed and defined pattern. The control and selection box 36 also acts to maintain a pre-selected pressure in the air reservoir 18. Upon a detected change in the pressure in the air reservoir 18 or in the ratio between the air reservoir 18 and the glue tank 24 the control and selection box 36 acts to replenish the depleted air supply by controlling the compressor 12. As the pressure in the air reservoir 18 is typically much higher than that in the glue tank 24, the control solenoid 26 acts to expose the glue tank 24 to the air reservoir 18 as needed to maintain the pre-selected pressure ratio and pre-selected pressure in the glue line 29.

First and second solid state relays 48, 50 respectively, are both also connected to the control and selection box 36. The first solid state relay 48 is connected between the control and selection box 36, the compressor 12 and the power supply 52. The second solid state relay 50 is connected between the control solenoid 26 and the control and selection box 36. Based upon the signals received from the pressure sensor interpretations circuit 34, the control and selection box 36 is connected to activate the first and second solid state relays 48, 50 thereby controlling the pressure within both the air reservoir 18 and glue tank 24 and the application of glue by the glue head 32 to the target.

The control and selection box 36 is connected to a first glue photo-eye head 42 including a lead photo-eye sensor 43 and a trailing photo-eye sensor 44. The lead and trailing photo-eye sensors 43, 44 respectively detect the position of a target passing through a glue application area and transmit signals indicative of the target's position to the control and selection box 36. When signals indicating the target is positioned within the glue application area are transmitted by the first glue photo-eye head 42, the control and selection box 36 will control the application of glue to the target. The control and selection box 36 is also connected to a second air photo-eye head 45 including a lead photo-eye sensor 46 and a trailing photo-eye sensor 47. The lead and trailing photo-eye sensors 46, 47 respectively detect when a target has passed through the glue application area and transmits signal indicative of the absence of the target from the glue application area to the control and selection box 36. When signals indicating the target is not positioned within the glue application area are transmitted by the second air photo-eye head 45, the control and selection box 36 will prevent the application of glue through the glue head 32 and control the application of air through the glue head 32 thus acting to clean the glue head 32.

As illustrated in FIGS. 2 and 3, a conveyor belt 54 extends below the glue head 32 whereby glue exiting the glue head 32 will be positioned on a target traveling with the conveyor 54 and passing by the glue head 32. The glue head 32 is positioned between both the glue lead photo-eye sensor 43 and air lead photo-eye sensor 46 and the glue trailing photo-eye sensor 44 and air trailing photo-eye sensor 47. The glue lead and trailing photo-eye sensors 43 and 44 accurately determine the position of the target on the conveyor 54 as it passes through the glue application area. The air lead and trailing photo-eye sensors 46 and 47 determine when a target is not positioned within the glue application area, they detect the leaving and entering of the target from the glue application area. FIG. 2 shows an embodiment including three glue heads 32 for placing a pattern of glue on the target. The target is carried on the conveyor 54 so as to pass below the photo-eye heads 42 and 45 and the glue heads 32. As depicted in FIG. 3, the conveyor 54 and thus the target move from right to left.

Figure 4:
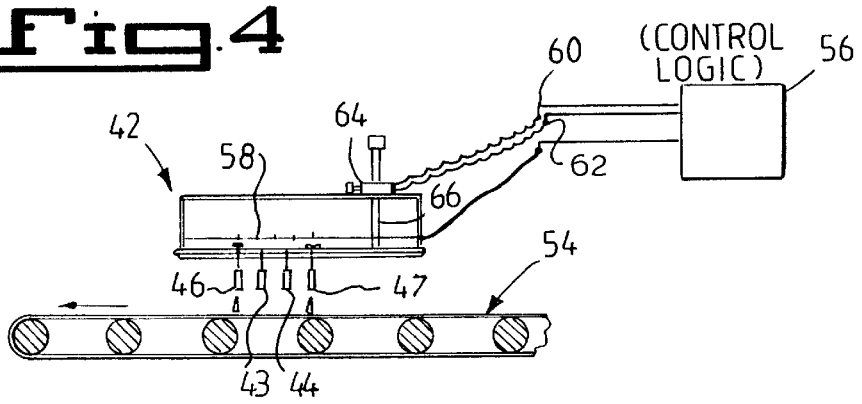
FIG. 4 is a schematic diagram of logic circuitry connected to the glue applicator system of the photo-fiber link glue control system of the present invention.

A control logic circuit 56 may be connected to the glue and air photo-eye heads 42 and 45 as illustrated in FIG. 4. The glue and air photo-eye heads 42 and 45 each include a plurality of adjustable position indicators 58 connected to the glue lead and trailing photo-eye sensors 43 and 44 and the air lead and trailing photo-eye sensors 46 and 47 for generating pulse signals indicating the position and aiding in the movement of the glue lead and trailing photo-eye sensors 43, 44 and air lead and trailing photo-eye sensors 46, 47, respectively. The control logic circuit 56 controls movement of the position indicators 58 and thus movement of the glue lead and trailing photo-eye sensors 43, 44 and air lead and trailing photo-eye sensors 46, 47, respectively, in response to receipt of the pulse signals from the position indicators 58. Based upon increases and decreases in the speed of the conveyor 54, the control logic circuit 56 sends signals to a stepper motor 64 via input and output control wires 60, 62 respectively. The stepper motor 64 may be in the form of a threaded shaft assembly wherein the input and output control wires 60, 62 act to turn the threaded shaft 66 in a clockwise or counter clockwise direction based upon the change in speed of the conveyor 54. The turning of the threaded shaft 66 acts to move the glue lead and trailing photo-eye sensors 43, 44 and air lead and trailing photo-eye sensors 46, 47, respectively, along the length of the conveyor 54. Movement of the photo-eye sensors allows for detection of the target either earlier or later along its path through the glue application area. The turning signals are determined by comparing the speed of the conveyor 54 to the oscillations of a fixed oscillator (not shown) within the control logic circuit 56.

Figure 5:
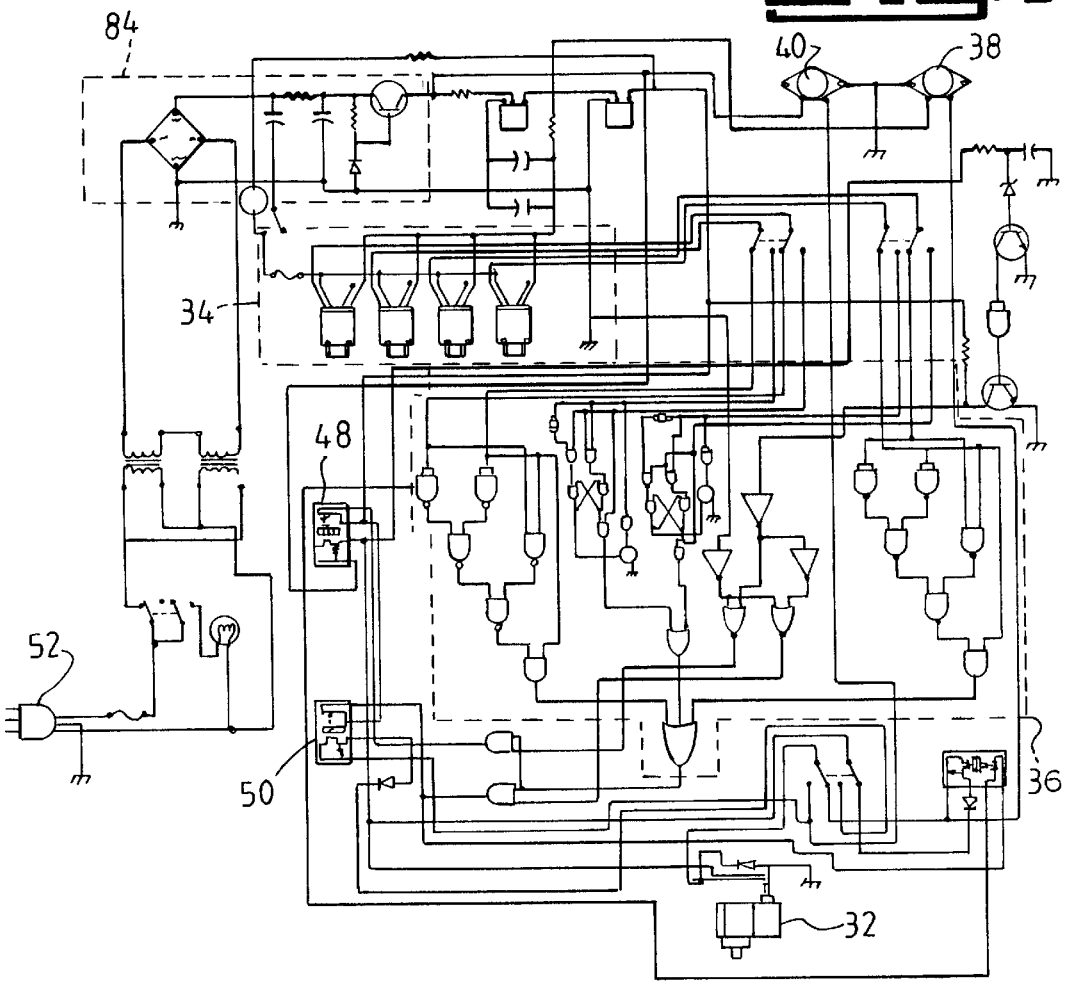
FIG. 5 is a logic diagram of the photo-fiber link glue control system illustrated in FIG. 1.

FIG. 5 illustrates a logic diagram of the present invention showing the logical iterations performed by the photo-fiber link glue system 10 in greater detail. These iterations regulate the amount of glue applied by the glue head 32 to a target and detect the position of the target as it passes the glue head 32 for accurate placement of the glue. The pressure sensor interpretations circuit 34, control and selection box 36 and power supply circuit 84 are discussed in more detail with reference to FIGS. 6, 7, and 8 respectively. FIG. 5 illustrates the interaction and connections between these components.

Figure 6:
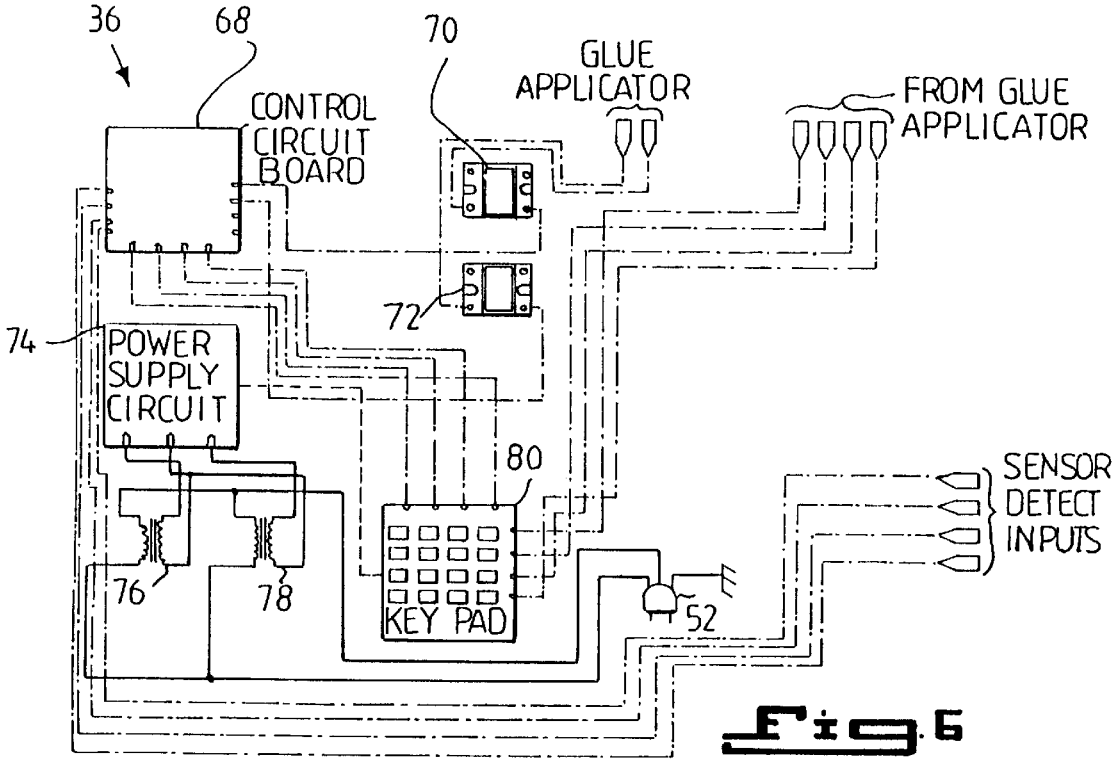
FIG. 6 is a schematic diagram of the control and selection box of the photo-fiber link glue control system of the present invention.

The control and selection box 36 is depicted in more detail in FIG. 6 and includes a keypad 66. The keypad 66 is used to select a particular sensor for activating a corresponding glue applicator 32. This allows only a single glue head applicator 32 to be operated at one time based upon the signals from a particular photo-eye sensor. Operation of any combination of sensor signals attempting to control a glue head applicator 32 is thus prohibited. The selections input to the keypad 66 are transmitted to and stored in a control circuit 68 for activating the appropriate glue head applicator 32 based upon input signals received from the glue lead and trailing photo-eye sensors 43 and 44. Based upon the signals from one of the glue photo-eye sensors 43 or 44, the control circuit board 68 delivers a signal to third and fourth solid state relays 70 and 72, respectively, which are connected to enable the appropriate glue head applicator 32. In combination with the control of the pressure in the glue tank 24, glue may now be applied to the target. When a signal indicating a target has passed out of the glue application area is received from the air trailing air photo-eye sensor 47, application of glue is prevented by the control and selection box 36 and air is caused to be delivered to the glue head applicators 32. When a signal indicating a subsequent target has moved into the glue application area is received from the air leading photo-eye sensor 46, delivery of air to the glue head applicators 32 is prevented and glue is allowed to pass to the glue head applicators 32 in accordance with the programmed glue pattern. The power source 52 is connected to supply voltage to the control and selection box 36. Voltage is fed to the keyboard 66 via a power supply circuit 74 and first and second transformers 76 and 78, respectively. The keyboard 66 is also used to input the glue pattern to be placed on the targets for storage in the control and selection box 36. Based upon the pattern input on the keyboard 66, the control and selection box 36 activates the glue head applicators 32 to place the glue on the target in accordance therewith.

Figure 9:
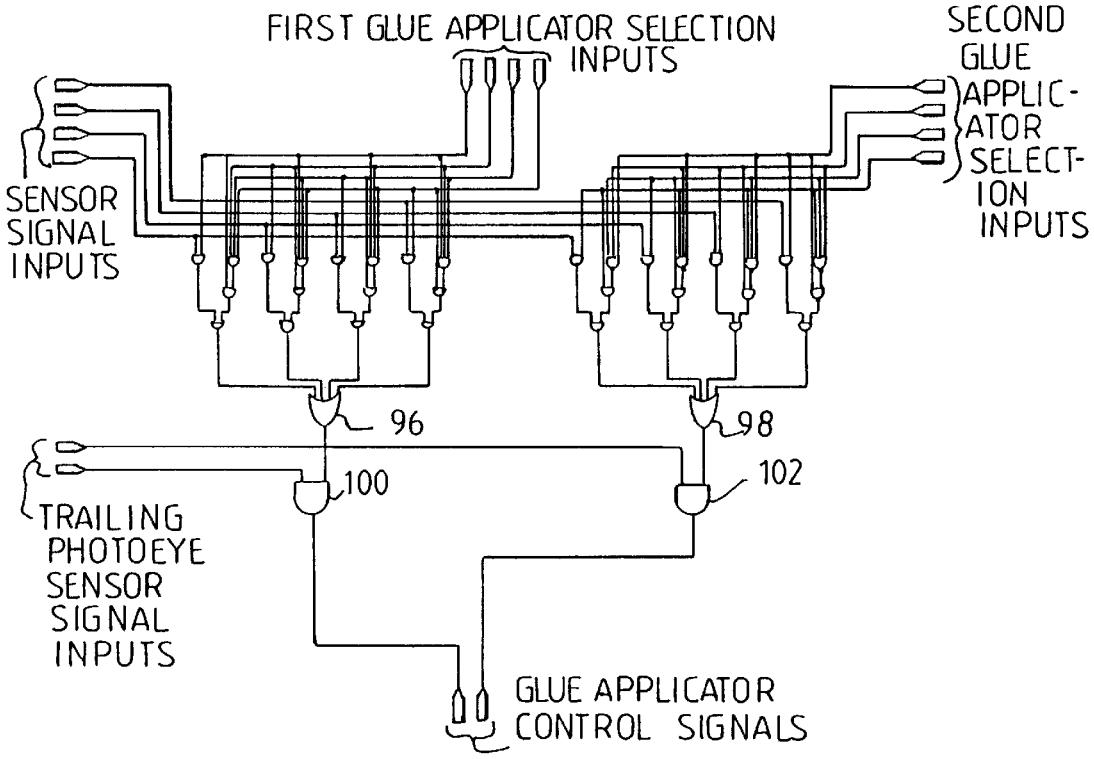
FIG. 9 is a logic diagram of the control and switching logic circuit of the photo-fiber link glue control system of the present invention.

The matching of one glue head applicator to a respective photo-eye sensor signal is accomplished by the logic circuit illustrated in FIG. 9. The sensor signals are combined in two groups of AND gates with different combinations of glue applicator selection symbols from the keypad 66. The first group of AND gates receives selection signals for a first glue applicator and the second group of AND gates receives selection symbols for a second glue applicator. After passing through the sequence of AND gates the resultant signals for the first glue applicator are passed to a first OR gate 96 and the resultant signals for the second glue applicator are passed to a second OR gate 98. The output of the OR gates 96 and 98 are each then fed with a signal from the trailing photo-eye sensor 46 to a respective AND gate 100, 102. The output of the AND gates 100 and 102 are transmitted to the glue applicators as control signals for applying glue to the target.

Figure 7:
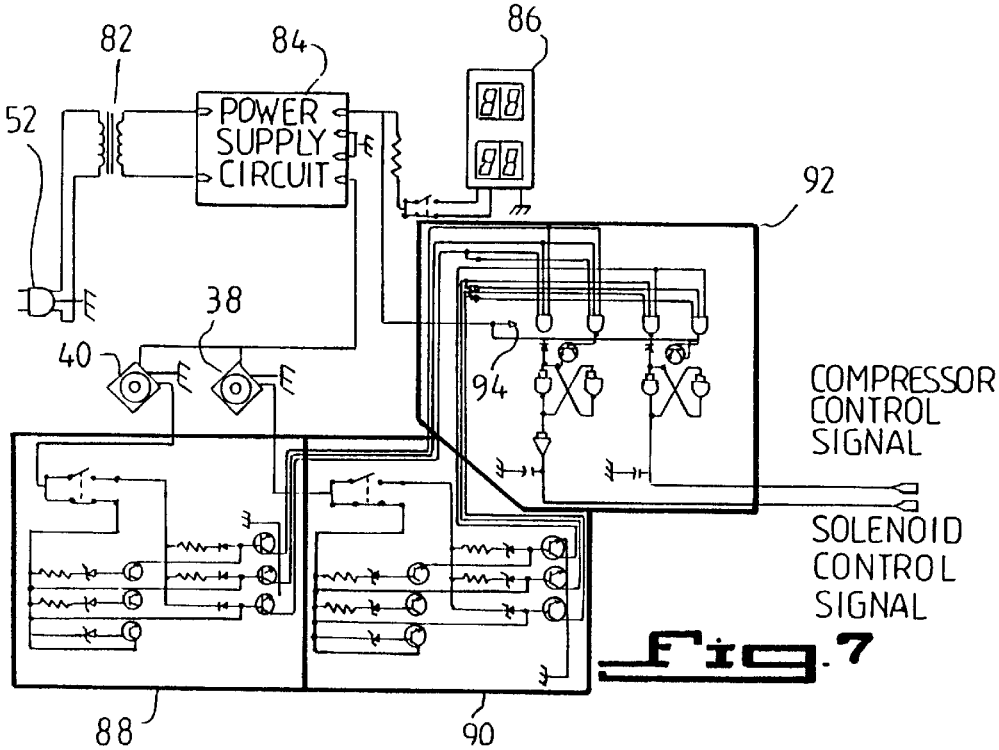
FIG. 7 is a logic diagram of the pressure sensor interpretation circuit of the photo-fiber link glue control system of the present invention.

The pressure sensor interpretations circuit 34 is depicted in more detail in FIG. 7 and is connected to the power source 52 through a third transformer 82 and power supply circuit 84. Pressure values from the air tank pressure sensor 38 and glue line pressure sensor 40 are received and analyzed to produce a compressor output signal and a control solenoid signal for output to the control and selection box 36 for ultimate control of the pressure within the air reservoir 18 and glue tank 24. The pressure values received from the air reservoir 18 and glue line pressure sensors 38, 40 are also displayed on an LED display 86. The pressure sensor interpretations box 34 is divided into two sections a read section for determining the pressure sensed and an action section for acting on the compressor 12 and control solenoid 26 based upon the read values. The read section 88, 90 is divided into two parts, a first part 88 for reading the glue line pressure value and a second part 90 for reading the air reservoir pressure value. The read values are fed into a sequence of logic gates in the action section 92 to produce control signals which will regulate the pressure of the glue line 29 and air reservoir 18. Each logic gate is individually supplied with power at an appropriate pin as depicted by the arrow 94.

Figure 8:
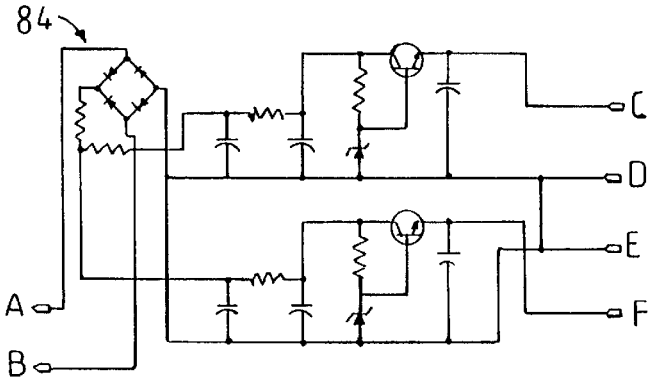
FIG. 8 is a logic diagram of the power supply circuit of the photo-fiber link glue control system of the present invention.

The power supply circuit 84 for providing power to the read section 88, 90 and action section 92 is illustrated in more detail by FIG. 8. The inputs A, B and outputs C, D, E and F are identical to those of FIG. 7. Inputs A and B are connected across the secondary winding of the third transformer 82 to receive power from the power supply 52. Output C supplies power to the action section 92 and output E supplies power to the read section 88,90 of the pressure sensor interpretations circuit 34. This is a standard known power supply for a micro-switch sensor and thus further discussion of such is not necessary.

Figure 10:
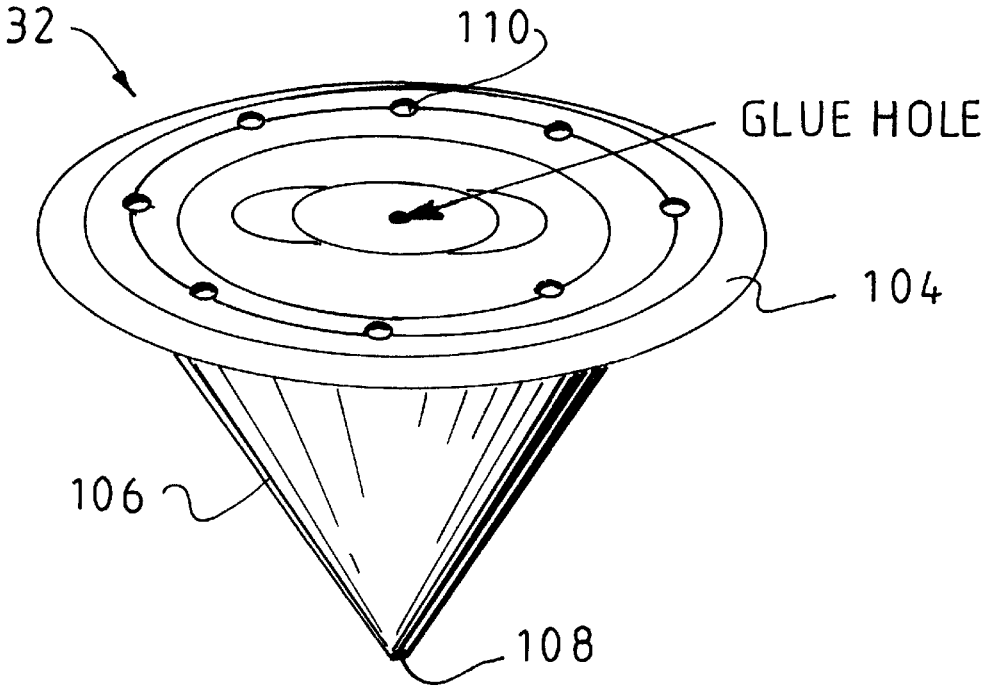
FIG. 10 is a top view of the glue head used to deposit glue by the photo-fiber link glue control system of the present invention.
Figure 11:
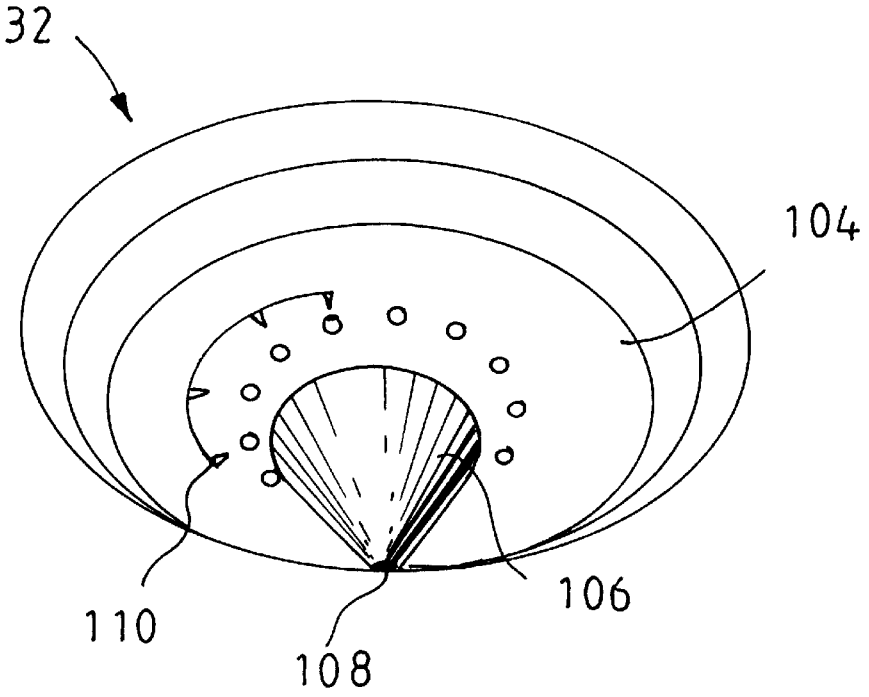
FIG. 11 is a side view of the glue head used to deposit glue by the photo-fiber link glue control system of the present invention.

A top and side view of the glue head 32 is illustrated in FIGS. 10 and 11, respectively. As is seen from these figures, the glue head 32 includes a base section 104 and a glue applicator section 106 depending therefrom. Extending from the base section 104 and through the glue applicator section 106 is a glue hole 108 for transmission of the glue supplied by the glue tank 24 therethrough. Extending through the base section 104 and surrounding the glue applicator section 106 are a plurality of air passages 110. The air passages allow the air supplied by the air reservoir 18 to pass therethrough and act to clean the glue hole 108 when glue is prevented from being applied.

In operation, a glue pattern to be formed on a sequence of targets is input to the keyboard 66 and stored in the control and selection box 36. This pattern will be accurately placed on each target passing on the conveyor 54 and through the glue application area. The keypad 66 is also used to input instructions associating each glue head applicator 32 with a particular sensor signal. Thus, only one glue head applicator 32 may be enabled at a single time and cannot be controlled by combinations of additional sensor signals.

The glue is stored in the glue tank 24 connected to the glue head 32 via the glue line 29, manifold 30 and control solenoid 26. The pressure in the glue tank 24 and thus the glue line 29 is controlled by an air compression system connected thereto. The pressure in both the air reservoir 18 and the glue tank 24 are constantly monitored by pressure sensors 38 and 40 and the monitored pressure values are transmitted to a pressure sensor interpretations circuit 34. The pressure values are constantly displayed on a display unit 86 for visually monitoring the pressure values.

The pressure values are also delivered to the control and selection box 36. Through the first and second solid state relays 48, 50 the control and selection box 36 controls the compressor 12 to supply air via the exhaust 16 and check valve 20 to the air reservoir 18. This acts to replenish the air within the air reservoir 18 and thus increase the pressure in the air reservoir 18 upon determination of a change in the air pressure. The first and second solid state relays 48, 50 are controlled to equalize the pressure based upon the determination of a pressure change in either the air reservoir 18 or glue line 29 or to increase the pressure in the glue tank 24 causing glue to flow to the glue head 32. Based upon the stored glue pattern and the detection of a target passing below the glue head 32, the glue is deposited on the target. Air is also delivered from the air reservoir 18 directly to the glue head 32 when a target is not passing through the glue application area for use in cleaning the glue head 32.

When a change in the pressure values from the preselected values in the air reservoir 18 and glue line 29 is detected, the first and second solid state relays 48 and 50 are activated. The first solid state relay 48 enables the compressor 12 to receive air for delivery to the air reservoir 18. The second solid state relay 50 activates the control solenoid 26 to allow the glue tank 24 greater exposure to the air reservoir 18 and thus allow an increased amount of air to pass to the glue tank 24 increasing the pressure therein. The change in pressure in the air reservoir 18 due to the increased air flow through the compressor 12 and activation of the control solenoid 26 causes air to flow into the glue tank 24 via the control solenoid 26 and second check valve 28 thereby increasing the pressure in the glue tank 24.

The position of the glue and air photo-eye sensors 42 and 45, respectively, is controlled by the control logic circuit 56 based upon the speed of the conveyor 54. The position of the glue photo-eye sensors 43 and 44 and the air photo-eye sensors 46 and 47 is determined by position indicators which transmit a signal indicative of the determined positions to the control logic circuit 56. As the speed of the conveyor 54 changes the position of the photo-eye sensors must be adjusted to reflect and react to this change. Thus, the speed of the conveyor 54 is constantly monitored by the control logic circuit 56 and compared to the oscillations of a crystal oscillator to determine if any changes have occurred. When a change in speed is detected, the control logic circuit 56 acts to control a threaded shaft assembly 64 to turn and adjust the position of the position indicators 58 and glue and air photo-eye sensors 43,44 and 46,47, respectively, connected thereto. As a target travels with the conveyor 54, the glue lead photo-eye sensor 43 detects its position on the conveyor 54 as the target enters the glue application area and transmits a signal to the control and selection box 36 indicating the position of the target.

Additional photo-eye sensors may be placed in other positions throughout the glue application area to detect when the target enters other positions and to more accurately determine the orientation of the target on the conveyor 54. The detection of these criteria aid in accurately placing the glue pattern on the target. Additional glue heads 32 may also be positioned throughout the glue application area for producing a more complex glue pattern on the target. Each glue head 32 may be associated with a particular glue photo-eye sensor 43 or 44. The keypad 66, as previously discussed, is used to input instructions which correlate the glue heads 32 and glue and air photo-eye sensors. This correlation allows only a single glue head applicator 32 to be activated at any one time in response to a signal from a particular glue photo-eye sensor, canceling the operation of any combination of signals attempting to control a glue head applicator 32 with a plurality of sensor signals. The keypad 66 and control circuit board 68 activate the control relays 70, 72 to enable the particular glue head applicator 32. This feature eliminates the possibility of human error by prohibiting operation of more than one glue head applicator at a time and the possibility of signals from more than one sensor activating numerous glue head applicators or affecting the control of the single activated glue applicator.

The control and selection box 36 analyzes the position signals generated by the glue photo-eye sensors 43 and 44. Based upon these signals and the stored glue pattern the first solid state relay 48 is enabled causing air to be received by the air reservoir 18 via the compressor 12, thus increasing the pressure therein and the second solid state relay 50 is enabled causing the control solenoid 26 to increase the exposure of the glue tank 24 and glue line 29 to the air reservoir 18 thereby increasing the pressure therein and causing glue to flow through the glue line 29. This causes a glue bead to be applied to the target at the desired position or positions. As the target passes through the glue application area, glue is placed thereon in accordance with the stored glue pattern using the above described method. Upon detecting the passage of the trailing edge of the target by the glue and air trailing photo-eye sensors 44 and 47, respectively, operation of the glue head applicators 32 is ceased thereby establishing a definite distance between the final glue bead placed on the target and the trailing edge of the target. At this time air is also caused to be supplied by the air reservoir 18 directly to the glue head 32. The air will be caused to flow through the air passages 110 in the base section 104 of the glue head 32 acting to clean glue remaining on the glue head 32 from the glue head 32 and glue passage 108.

When the glue and air leading edge sensors 43 and 46, respectively, detect a subsequent target entering the glue application area, the air supplied from the air reservoir directly to the glue head 32 is ceased and enabling the glue head applicators 32 allowing glue to once again flow through the glue head 32. Application of glue to the target is then repeated in accordance with the programmed glue pattern. By detecting the leading and trailing edges of the target in this manner, it is possible to create the same glue pattern on subsequent targets passing through the glue area while accounting for the speed of the conveyor, placement of the target on the conveyor and other mechanical tolerances. It is also possible to prevent glue from being deposited on the conveyor belt 54 and continually clean glue remaining on the glue head 32 therefrom.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed is:

1. A photo-fiber link glue control system for accurately placing a pattern of glue on a sequential series of targets, each target having a lead and trailing edge, traveling with a conveyor through said system, said photo-fiber link glue control system comprising:

a) air compression means;

b) glue supply means connected to said air compression means for storing glue to be applied to the series of targets;

c) glue head means for receiving glue from said glue supply means and applying the glue to the series of targets;

d) first photo-eye sensor means for detecting the lead and trailing edge of the target and generating a target position signal based upon the detection;

e) pressure sensor means for sensing a pressure within said air compression means and glue supply means and generating a pressure signal indicative of the sensed pressures;

f) control means for storing a pattern for the application of glue to the target, said control means being connected to receive said position signal from said first photo-eye sensor and said pressure signal from said pressure sensor means, wherein said control means determines a position of the target on the conveyor based upon the position signal and controls said pressure within said air compression means to supply air to said glue supply means thereby increasing pressure within said glue supply means and causing glue to flow from said glue supply means to said glue head means for placement on the target in accordance with the stored pattern and said determined position of said target;

g) a second photo-eye sensor means connected to said control means for detecting the trailing and leading edges of the target for controlling the application of air through said glue head means to clean said glue head means when the target is not positioned in the glue application area and generating a glue prevention signal to prevent glue from being delivered to said glue head means upon receipt of said glue prevention signal.

2. The photo-fiber link glue control system as recited in claim 1, wherein said glue head means is also connected to said air reservoir and said control means causes air to be delivered directly to said glue head means upon receipt of said glue prevention signal.

3. The photo-fiber link glue control system as recited in claim 2, wherein said second photo-eye sensor means is able to detect a subsequent target entering said glue application area and generating a glue application signal upon detecting the subsequent target entering the glue application area, wherein said control means allows glue to again be delivered to said glue head and prevents air from being delivered to said glue head means upon receipt of said glue application signal.

4. The photo-fiber link glue control system as recited in claim 1, wherein said air compression means includes:

a) an air compressor having an air intake valve for receiving air and an air exhaust valve; and b) an air reservoir connected to said air exhaust valve for receiving air from said air compressor thereby increasing air pressure within said air reservoir upon receipt of said control signal by said compressor.

5. The photo-fiber link glue control system as recited in claim 4, wherein said system further comprises:

a) a control solenoid connected between said air reservoir and said glue supply means;

b) a first solid state relay connected between said control means and said air compressor for receiving said control signal from said control means and activating said air compressor to receive air through said air intake valve upon receipt of said control signal; and c) a second solid state relay connected between said control means and said control solenoid for receiving said control signal from said control means and activating said control solenoid to expose said glue supply means to said air reservoir and thereby increase pressure in said glue supply means based upon said control signal.

6. The photo-fiber link glue control system as recited in claim 5, further comprising a pressure sensor interpretations circuit connected to receive said pressure signals from said pressure sensing means, for analyzing said pressure signals to determine if said pressure in said air reservoir and said glue supply means are equal to a predetermined value and signaling said control means to activate said air compressor and control solenoid based upon a determination said pressure signals is different from said predetermined value.

7. The photo-fiber link glue control system as recited in claim 4, wherein said pressure sensor means includes a first pressure sensor connected to sense said pressure in said air reservoir and a second pressure sensor connected to sense said pressure in said glue supply means.

8. The photo-fiber link glue control system as recited in claim 2, wherein said second photo-eye sensor means includes a lead photo-eye sensor for detecting the leading edge of a target entering the glue area and a trailing edge photo-eye sensor for detecting the trailing edge of the target.

9. The photo-fiber link glue control system as recited in claim 8, wherein said glue head means includes a plurality of glue heads for producing a complex glue pattern on the targets.

10. The photo-fiber link glue control system as recited in claim 1, wherein said control means includes a keypad for use in externally inputting a glue pattern for storage in said control means.

11. The photo-fiber link glue control system as recited in claim 10, wherein said first photo-eye sensor means includes a plurality of photo-eye sensors each connected to said control means for sensing a position of the target and transmitting a signal indicative of the sensed position to said control means.

12. The photo-fiber link glue control system as recited in claim 11, wherein each of said plurality of glue applicators is enabled to apply glue to the target based upon a respective first photo-eye sensor signal, each of said plurality of glue applicators and respective first photo-eye sensor signals being correlated based upon instructions input to said keypad.

13. The photo-fiber link glue control system as recited in claim 12, wherein, upon activation of a first one of said plurality of glue heads, said control means disables all remaining glue heads.

14. The photo-fiber link glue control system as recited in claim 13, wherein said trailing edge photo-eye sensor of said first photo-eye sensor determines a distance between a glue bead placed on the target and the trailing edge of the target.

15. The photo-fiber link glue control system as recited in claim 14, wherein said trailing photo-eye sensor of said first photo-eye sensor disables said glue head means upon detection of the trailing edge of the target.

16. The photo-fiber link glue control system as recited in claim 15, wherein said lead photo-eye sensor of said first photo-eye sensor enables said glue head means upon detection of the lead edge of the target.

17. The photo-fiber link glue control system as recited in claim 16, wherein said pressure sensor interpretations circuit further includes an LED display for visually displaying said pressure signals.

18. The photo-fiber link glue control system as recited in claim 17, further comprising a position control device for detecting a position of said first and second photo-eye sensor means and changes in a speed of the conveyor and adjusting said first and second photo-eye sensor means based upon a detection of a change in the speed of the conveyor.

19. The photo-fiber link glue control system as recited in claim 18, wherein said position control device includes:

a) position indicators connected to said photo-eye sensor means for detecting a position of said photo-eye sensor means;

b) analysis means for analyzing said position detected by said position indicators and said speed of said conveyor and producing a control signal based upon said analysis; and c) stepper motor means connected between said analysis means and said photo-eye sensor means for adjusting a position of said photo-eye sensor means upon receipt of said control signal from said analysis means.

* * * * *